US006399264B1

(12) United States Patent
Ogata et al.

(10) Patent No.: US 6,399,264 B1
(45) Date of Patent: Jun. 4, 2002

(54) DEVELOPER FOR ELECTROSTATIC LATENT IMAGE

(75) Inventors: Kenzo Ogata; Kazuhiro Hirama; Shinichi Saiki, all of Virginia Beach, VA (US)

(73) Assignee: Mitsubishi Chemical America, Inc., Chesapeake, VA (US)

( * ) Notice: Subject to any disclaimer, the term of this patent is extended or adjusted under 35 U.S.C. 154(b) by 0 days.

(21) Appl. No.: 09/695,390

(22) Filed: Oct. 25, 2000

(51) Int. Cl.[7] ..... G03G 13/08; G03G 9/083

(52) U.S. Cl. ..... 430/120; 430/108.3; 430/108.4; 430/108.6; 430/108.7; 430/111.41

(58) Field of Search ..... 430/110, 111, 430/120, 902, 106.6, 108.6, 108.7, 108.3, 108.4, 106.1, 11.41

(56) References Cited

U.S. PATENT DOCUMENTS 4,584,253 A * 4/1986 Lin et al. ..... 430/60
6,004,711 A 12/1999 Bourne et al. ..... 430/106.6
6,020,054 A * 2/2000 Masuda et al. ..... 428/319.3
6,087,059 A * 7/2000 Duggan et al. ..... 430/111
6,117,607 A * 9/2000 Shimizu et al. ..... 430/110
6,214,507 B1 * 4/2001 Sokol et al. ..... 430/110

FOREIGN PATENT DOCUMENTS

JP 9-236942 * 9/1997

OTHER PUBLICATIONS

Derwent Machine–Assisted Translation of JP 9–236942 (Pub Sep. 1997).*
Japanese Patent Office Machine—Translation of JP 9–236942 (Pub Sep. 1997).*
Derwent Abstract Acc. No. 1997–499756 of Japanese Patent No 9–236942, 1997.

* cited by examiner

*Primary Examiner*—Janis L. Dote
(74) *Attorney, Agent, or Firm*—Oblon, Spivak, McClelland, Maier & Neustadt, P.C.

(57) ABSTRACT

An electrostatic developer comprising a mixture of (1) toner components containing image-forming particles, (2) positively charged particles, (3) negatively charged particles, and (4) a lubricant.

21 Claims, No Drawings

DEVELOPER FOR ELECTROSTATIC LATENT IMAGE

BACKGROUND OF THE INVENTION

1. Field of the Invention

The present invention relates to a developer for developing electrostatic latent images in electrophotography, electrostatic recording and electrostatic printing. More specifically, the present invention is directed to a composition and method that provides a developer which comprises at least positively charged particles, negatively charged particles and a lubricant to ensure the elimination of ghosting and system contamination, as well as maintaining a stable, high quality image, during extended use.

2. Description of the Background

Visible image forming methods associated with toners using electro-photographic systems have been extensively studied and are currently widely used. Typical examples of these techniques are dual-component developing methods, which use image-forming particles and often larger carrier particles, and mono-component developing methods, which use a toner comprising only magnetic or non-magnetic image-forming particles. Details of such developing methods are described in Kirk-Othmer, *Encyclopedia of Chemical Technology*, $4^{th}$ ed., 9:261–275 (1994).

An image forming apparatus utilizing an electrophotographic method with toner is well known. In the image forming apparatus utilizing the electrophotographic method, images are generally formed onto a sheet of copy paper through the following processes.

After uniformly charging a photoconductor that serves as an image-holding body, images are exposed onto the surface of the charged photoconductor. Attenuating electrostatic charges during the exposure of light forms a latent image. Then the electrostatic latent images are visualized by developing with toner to form a toner image. The toner images are transferred onto the aforementioned medium and thereafter fixed on it by heating, pressure or solvent vapor.

In recent years, accompanying the rapid growth of computer technology, digital copiers and printers have been developed and become widely used. In these machines, monocomponent-developing methods have been applied more often to reduce the number of supply parts and ease of customer maintenance requirements compared with that of the dual component method.

In the mono-component systems, toner is generally required to have good fluidity and uniform chargeability in order to form a good quality visible image as described in U.S Pat. No. 5,802,284 incorporated herewithin by reference. The use of silica powder additives for toner particles to impart fluidity and chargeability properties has been widely studied and is one conventionally accepted method. Many US patents are known that include the use of silica or silicon dioxide with toner of various compositions. A subset of this prior art relates to surface treatments of silica or silicon dioxide for specific purposes to somehow enhance image quality characteristics relating to electrophotography. Examples of the use of hydrophobic silica particles for toner includes JP 46-5782 A, JP 48-47345A, and JP 48-47346A.

U.S. Pat. No. 5,464,722 and U.S. Pat. No. 5,447,815 disclose the manufacture of toners and the use of silicone oils and varnishes for treating toner additives, such as hydrophobic silica fine powder.

U.S. Pat. No. 4,868,084 includes the use of a silica treated with a silicone oil and alkyl silane or disilazane compound.

U.S. Pat. No. 5,702,858 and U.S. Pat. No. 5,561,019 are specific to the use of negatively charged hydrophobic silica treated with a silicone oil.

U.S. Pat. No. 4,902,570 discloses a process for treating metal oxides surfaces, such as silicon dioxide, by use of a modified ammonium-functional organopolysiloxane as a charge control substances for toners.

U.S. Pat. No. 4,618,556 discloses the use of a positive charge controller comprising fumed silica particles treated with a coupling agent bonded to either Si or Ti for use in a developer comprising a binder resin, colorant, and said positive charge controller.

U.S. Pat. No. 5,695,902 specifically describes the use of toner with an inorganic fine powder treated at least with silicone oil and a particular size composite metal oxide containing Si and Sr.

U.S. Pat. No. 6,004,711 discloses a toner composition with an extra-particulate additive having a negative charge and a second extra-particulate additive having a positive charge. This patent is concerned with addressing a problem of a wavy patterns formed when using a recoated or worn developer magnetic roller. The patent discloses that the toner composition therein includes conventional toner components in conventional amounts including zinc stearate, abrasives, microspheres, and the like.

Electrophotographic systems have also been known to include metal salts of fatty acids. For example, JP09-236942 discloses such metal salts to avoid the toner filming of an organic photoconductor (OPC) with the aid of cleaning blades. The metallic salt works to reduce this filming of the OPC drum and together with the use of spherical toner, filming has been shown to be greatly reduced. As the concentration of metallic fatty acid salts increase, the toner accepts charge more readily within a specified range. In this work, it was also found that if Ds50/Dt50>0.6, wherein Ds50 represents the volume median particle size of metallic salts of fatty acids and Dt50 represents the volume median particle size of the toner component particles, contamination of the laser printer machine components will occur resulting in prints with high background. If Ds84/Ds16>6, wherein Ds 84 represents the diameter at 84% of the accumulated undersize distribution curve of the metallic fatty acid particles and Ds16 represents the diameter at 16% of the accumulated undersize distribution curve of the metallic fatty acid particles, then the uniformity of the metallic salts of fatty acids particle size is broad and the charging stability exhibited in the toner is not acceptable. These particle size and particle size distribution values are as determined by a dry measurement technique using a Heros and Redos laser diffraction instrument manufactured by Sympatec.

In the actual toner composition product design, the silica particles must be carefully selected to minimize side effects such as environmental instability, ghosting, photo-conductor contamination, and photo-conductor charging system contamination as well as any adverse side-effects on image quality. Generally, silica particles have a finer particle size than toner particles and therefore the silica particles possess a larger specific surface area and higher charging properties which can largely influence overall toner performance.

Environmental stability improvement by modification of the silica surface with chemical treatment has been widely studied and reported. Hydrophobic treatment is an established method of providing environmental stability to the toner.

Ghosting is a typical defect often seen in monocomponent development systems and can be described as developed image forming toner patterns on a latent image-retaining member, which are electrostatically transferred to a transfer material such as paper and form either lighter images than the background or darker images than the background. In instances where the ghost image is lighter than the background, this phenomena is known as "negative ghosting" and where the ghost image is darker than the background, this phenomenon is known as "positive ghosting." Because the ghosting phenomenon is complex and results from actual electrostatic printer orcopy machine system characteristics, toner flowability, toner triboelectric charge properties, and even exponential memory decay time of the photoconductor, the root cause is still not perfectly understood. It is often possible; however, to measure the distance between ghost images to determine which component makes the larger contribution to this undesirable imaging characteristic.

If the ghost image (negative or positive type) appears on the transfer material (paper) in proportion to the photoconductor circumference, this can usually be attributed to the photoconductive drum allowing a "memory defect" to occur. I this case, the ghosting pattern normally repeats itself on the transferred media several times. If, however, the ghost image appears on the transfer paper in proportion to the development sleeve circumference, this can normally be associated with the periodically formed heterogeneous toner charge pattern on the development sleeve. In other words, if the charge properties of the toner are insufficiently balanced by adding the silica powder, ghosting, as described above, could occur. So, careful design of the addition of silica particles to the toner composition must be performed to avoid or minimize this ghosting. In addition to this, the design of the overall toner composition requires that there be minimal contamination by the toner to any of the electrophotographic system components, such as the photoconductor or (especially) the direct photoconductor charging apparatus.

Based on recent concerns regarding protection of the environment from ozone generating devices, an ozone-free (or greatly reduced) charging system is highly desirable and demanded by many customers. A conventional photoconductor charging method such as the corotron and scorotron systems are simple in terms of manufacturing technique; however they also generate much ozone during operation. A contact photo-conductor charging method which generates much less ozone has been studied extensively and is now widely used. Generally, a charger in the system uses a solid conductive roller, referred to as the contact charging roller or CCR. The normally applied high voltage to the CCR generates a positive or negative charge with respect to the overall machine system. Oppositely charged substances may accumulate on the CCR and the photoconductor surface causing contamination and creating image defects such as spots or lines on the paper. These and other defects are attributable to remaining toner on the photo-conductor surface after the transfer step which can contaminate the CCR and the photoconductor by means of contact pressure between these two components. Another contributing factor is the electrostatic forces that exist between the toner and the CCR and the toner and the photoconductor.

It is thus desirable that the fine particles included to the overall toner composition be selected such that at least the requirement of elimination of ghosting, and the requirement that the CCR and photoconductor be less contaminated with undesirable accumulated toner, are ensured. Use of conventional toner compositions and techniques for use with specific printer and copy machines have been unsuccessful in improving performance and maintaining longevity of toner for these applications.

SUMMARY OF THE INVENTION

It is an object of the present invention to provide a toner-containing electrostatic developer composition, manufacture, and method of using such a composition wherein toner performance is controlled such that the toner is suitable for the specific development system, and is capable of a stable high image quality such as image density, background, resolution and other general requirements during long term use.

Another object of the present invention is to provide a toner that eliminates ghosting phenomena especially in monocomponent development systems.

Another object of the present invention is to provide a toner which is capable of stable long-term performance without any undesired toner contamination of the electrophotographic system including the photoconductor and direct photoconductor charging apparatus.

The objects of the present invention are obtainable by using an electrostatic developer which comprises a mixture of (1) toner components containing image-forming particles, (2) positively tribocharged particles, (3) negatively tribocharged particles, and (4) a lubricant.

DETAILED DESCRIPTION OF THE INVENTION

The electrostatic developer components of the present invention comprises a mixture of (1) toner components containing image-forming particles, (2) positively tribocharged particles, (3) negatively tribocharged particles, and (4) a lubricant. Thus, the objects of the present invention are obtainable by using the above electrostatic developer.

The objects of the present invention are more preferably obtainable when the lubricant is a specified metallic fatty acid salt particle with the following chemical structure:

$$M\{OOC—(CH_2)n—CH_3\}_m$$

where n=5–100, m=1–5 and M denotes mono or multivalent cation(s).

The objects of the present invention are even more preferably obtainable when the lubricant is the above-specified metallic fatty acid salt particle wherein the ratio of $Ds50/Dt50 \leqq 0.9$, and even more preferably $\leqq 0.6$, where Ds50 is the median volume diameter of the metallic fatty acid particles and Dt50 is the median volume diameter of the toner particles, and/or wherein the ratio of $Ds84/Ds16 \geqq 8.0$, where Ds84 represents the diameter at 84% of the accumulated undersize distribution curve of the metal fatty acid salt particles and Ds16 represents the diameter at 16% of the accumulated undersize distribution curve of the fatty metal acid particles, respectively.

The above combination of components allows for high image density and clear images without ghost images or background formed during the electrophotography process. The development of this process is at high-resolution power and indicates improved electrostatic recording is obtainable.

In electrophotography, electrostatic recording, or the like, in which the developing method and the toner according to the present invention are used, the image-forming particles do not transfer to the non-image area and clear images can be formed, as well as unnecessary consumption of the image-forming particles can be suppressed, thereby providing great industrial merit. The invention provides for elimination of the phenomenon described as ghosting and background and results in better long-life results.

Toner Components

The toner in the present invention can be prepared by any of the generally known methods in the art and various known toner constituent ingredients can be used. In addition, the possibility exists to utilize "polymerized" toner.

For "non-polymerized" or conventional toner, the binder resin for the toner can be selected from a wide variety of materials including known thermoplastic resins. There can be mentioned, for example, styrene resin (homo- or copolymer containing styrene or substituted styrene) such as a polystyrene, polychlorostyrene, poly- -methylstyrene, styrene-chlorostyrene polymer, styrene-propylene copolymer, styrene-butadiene copolymer, styrene-vinyl chloride copolymer, styrene-vinyl acetate copolymer, styrene-maleic acid copolymer, styrene-acrylate copolymer (for example, styrene-methyl acrylate copolymer, styrene-ethyl acrylate copolymer, styrene-butyl acrylate copolymer, styrene-octyl acrylate copolymer and styrene-phenyl acrylate copolymer), styrene-methacrylate copolymer (for example, styrene-methyl methacrylate copolymer, styrene-ethyl methacrylate copolymer, styrene-butyl methacrylate copolymer and styrene-phenyl methacrylate copolymer), styrene-methyl á-chloroacrylate copolymer and styrene-acrylonitrile-acrylate copolymer, vinyl chloride resin, resin modified maleic acid resin, phenolic resin, epoxy resin, saturated or unsaturated polyester resin, low molecular weight polyethylene, low molecular weight polypropylene, ionomer resin, polyurethane resin, silicone resin, ketone resin, ethylene-ethyl acrylate copolymer, xylene resin and polyvinyl butyral resin. Preferred resins include styrene resin, and saturated or unsaturated polyester resin. Further, the above-mentioned resins may be used not only alone, but also as a combination of two or more of them.

In order to use the toner of the present invention in the form of a magnetic toner, magnetic powder generally known in the art may also be incorporated therein. The magnetic powder for the toner of the present invention is preferably chosen from the ferromagnetic materials exhibiting ferromagnetism including ferrimagnetism in a working circumstance temperature (around 0° to 60° C.) for office business machines, plain paper copiers, printers, etc. For example, there can be mentioned magnetic powder showing ferromagnetism or ferrimagnetism in a temperature range of about 0° to 60° C., selected from magnetite ($Fe_3O_4$), maghemite (—$Fe_2O_3$), a complex of magnetite and maghemite, spinal ferrite such as ferrite ($M_xFe_{3-x}O_4$ in which M represents Mn, Fe, Co, Ni, Cu, Mg, Zn, Cd or mixed crystal materials thereof), hexagonal ferrites such as $BaO.6Fe_2O_3$, garnet-type oxide such as $Y_3$ $Fe_5O_{12}$, retile-type oxide such as $CrO_2$, metal such as Fe, Mn, Ni, Co, and Cr, as well as other ferromagnetic alloys. Among them, a powder of magnetite, maghemite or a complex product of magnetite and maghemite with an average particle size of not more the 3 $\mu$m, more preferably about 0.01 to 1 $\mu$m are preferred in view of the performance and the cost. The above-mentioned magnetic powder may be used not only alone but also as a combination of two or more of them.

As an example of manufacture of a mono-component electrostatic developer containing a magnetic toner, the blending weight ratio of the binder resin to the magnetic powder can be selected within a range from 1:3 to 7:1, while taking the fixing property to a transfer material into consideration.

As a colorant used for the toner, any of known dyes and pigments such as carbon black, lamp black, ultramarine, nigrosine dye, aniline blue, phthalocyanine blue, phthalocyanine green, hanza yellow G, rhodamine type dye and pigment, chrome yellow, quinacridone, benzidine yellow, rose bengale, triallylmethane dyes, monoazo and disazo dyes and pigments may be used alone or in admixture. The addition amount of the colorant into the toner is preferably from 0.1 to 30 parts by weight, more preferably 0.5 to 10 parts by weight, based on 100 parts by weight of the binder resin. The fixing properties become poor if the amount is excessive, thus showing tendencies in property performance that is undesirable.

The toner used in the present invention may preferably contain a low-molecular weight wax in an amount of from 0.1 parts to 20 parts by weight, and more preferably from 0.5 to 10 parts by weight, based on 100 parts by weight of the binder resin component. The low-molecular weight wax contained in the magnetic toner of the present invention may include the following: alicyclic hydrocarbon resin, aromatic petroleum resin, chlorinated paraffin and paraffin wax, aliphatic hydrocarbon waxes such as low-molecular weight polypropylene, hydrocarbon waxes, such as oxidized polyethylene wax; block copolymers of these; waxes mainly composed of aliphatic esters, such as carnauba wax, saozole wax and monotate wax; and waxes obtained by deodorizing partly or wholly fatty acid esters, such as deodorized carnauba wax. It may also include straight chain saturated fatty acids such as palmitic acid, stearic acid and montanic acid; unsaturated fatty acids such as brassidic acid, eleostearic acid and parinnaric acid; saturated alcohols such as stearyl alcohol aralkyl alcohol, behenyl alcohol, carnaubyl alcohol, cetyl alcohol and melissyl alcohol; polyhydric alcohols such as sorbitol; fatty acid amides such as linolic acid amide, oleic acid amide, and lauric acid amide; saturated fatty acid bisamides such as methylenebisstearic acid amide, ethylenebiscapric acid amide, ethylenebislauric acid amide, and hexamethylenebisstearic acid amide; unsaturated fatty amides such as ethylenebisoleic acid amide, hexamethylenebisoleic acid amide, N,N'-bisdi-oleyladipic acid amide and N,N'-bisdioleylsebacic acid amide; aromatic bisamides such as xylenebisstearic acid amide and N,N'-distearylisophthalic acid amide; fatty acid metal: salts (what are commonly called metal soaps) such as calcium stearate, calcium laurate, zinc stearate, and magnesium stearate; waxes obtained by grafting vinyl monomers such as styrene and acrylic acid onto aliphatic hydrocarbon waxes; partially esterified products of fatty acids such as behenic acid monoglyceride with polyhydric alcohols; and methyl ester compounds having a hydroxyl group, obtained by hydrogenation of vegetable fats and oils.

In addition, auxiliary agents such as various kinds of plasticizers and releasing agents may also be added to the toner for adjusting thermal properties, physical properties, etc. The addition amount thereof is preferably from 0.1 to 10 parts by weight based on 100 parts by weight of the toner.

The charging property of the toner in the present invention may be controlled by the binder resin or the dye and pigment per se and, if required, a charge control agent causing no problem in view of the color reproduction may also be used together. It is also possible to include charge control resins.

Examples of the charge controller are well known by way of reference for example, U.S. Pat. No. 4,957,840. For positive charge control agents, examples may include: nigrosine and its modification products modified by a fatty acid metal salt; quaternary ammonium salts such as tributylbenzyl-ammonium-1 hydroxy-4-naphthosulfonic acid salt, and tetrabutylammonium tetrafluoroborate; diorganotin oxides, such as dibutyltin oxide, dioctyltin oxide, and dicyclohexyltin oxide; and diorganotin borates, such as dibutyltin borate, dioctyltin borate, and dicyclo-hexyltin borate; and triphenylmethane compound. These positive charge controllers maybe used singularly or as a mixture of two or more species. As another type of positive charge controller, there may be use of a homopolymer of a monomer having an amino group represented by the formula:

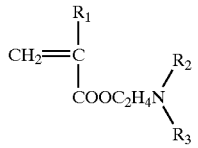

wherein $R_1$ represents H or $CH_3$; and $R_2$ and $R_3$ each represent a substituted or unsubstituted alkyl group (preferably $C_1$–$C_4$); or a copolymer of the monomer having an amine group with another polymerizable monomer such as styrene, acrylates, and methacrylates as described above. In this case, the positive charge controller may also play functions as a binder.

Examples of negative charge control agents include: metal complexes or salts of monoazo dyes, salicylic acid, alkylsalicylic acid, dialkylsalicylic acid, naphthonic acid, or acetylacetone. It is preferred that the above-mentioned charge controller is used in the form of fine powder. In such a case, the number-average particle size thereof may preferably be 4 microns or smaller, more preferably 3 microns or smaller.

In the case of internal addition, such charge controller may preferably be used in an amount of 0.1–20 wt. parts, more preferably 0.2–10 wt. parts, per 100 wt. parts of a binder resin by taking into consideration the conditions for the manufacturing method including the chargeability of the binder resin, the addition amount of the colorant and the dispersion method, as well as the chargeability of the other additives.

The toner in the present invention may preferably have a volume median particle size from 4 to 20 $\mu$m, more preferably from 5 to 15 $\mu$m, and most preferably from 6 to 12 $\mu$m, where the volume median particle size is obtained by using a Coulter counter Model Multisizer with a 100 micron aperture.

Positively Charged Particles and Negatively Charged Particles

The negatively tribocharged particles and positively tribocharged particles used in the present invention are hydrophobic and maybe prepared by any of the methods known in the art. These particles also can be prepared by the proper treatment of organic particles and/or inorganic particles.

The organic particles that are employed in the toner compositions may be preferably chosen from resinous materials. Examples of such resinous materials are exemplified by, but not limited to, thermoplastic resins such as polystyrenes, polymethyl methacrylate, polyolefin resins, polyamide resins, polycarbonate resins, polyether resins, polysulfone resins, polyester resins, epoxy resins, polybutyral resins, urea resins, urethane/urea resins, silicon resins, polyethytlene resins, Teflon resins and the like (fluoropolymer resins), thermosetting resins, a mixture thereof, block copolymers thereof, graft copolymers thereof, a blend thereof, and the like.

The inorganic oxide particles that are employed for toner compositions may also be prepared by any methods known in the art and are preferably selected from the group consisting of $SiO_2$, $Al_2O_3$, $W_2O_3$, $ZrO_2$, SeO, $TiO_2$, ZnO and MgO. The particles preferably have a BET measurement value of not less than 1 $m^2/g$, more preferably not less than 30 $m^2/g$ and even more preferably not less than 100 $m^2/g$.

In a preferred embodiment, the negatively charged particles comprise a chemically treated fumed silica which is prepared by gaseous phase oxidation of a silicon compound or colloidal silica which is prepared by a liquid phase chemical reaction. A material which can be preferably used for chemical treatment is an organic silicon compound and examples include, but are not limited to, organodisilazane such as hexamethyldisilazane, trimethylsilane, trimethylchlorosilane, trimethyoxysilane, dimethyldichlorosilane, methyltriclorosilane, allyldimethylchlorosilane, allylphenyldichlorosilane, benzyldimethylchlorosilane, bromomethyldimethylchlorosilane, chloromethyldimethylchlorosilane, triorganosilylmercaptans, triorganosilylacrylates, vinyldimethylacetoxysilane, diorganomethoxysilanes, cyclic organosiloxanes such as dimethyl cyclopolysiloxane, e.g., octamethyl cyclotetrasiloxane (OCTS), 1,3-divinyltetramethyldisiloxane, 1,3-diphenyltetramethyldisiloxane, fluorinated siloxane, polymethylphenylsiloxane, dimethylpolysiloxane, and polydimethylsiloxane. Silica particles may be treated with one or more organic silicon compounds to render a negative charge property as well as hydrophobic characteristics. Examples of such treatment are as described in U.S. Pat. No. 5,686,054, which is hereby incorporated by reference, where the organosilicon compounds employed are preferably organosilanes of the formula:

$$R^1_nSiX_{4-n}$$

in which $R^1$ is identical or different and is monovalent, optionally halogenated, hydrocarbon radical having 1 to 18 carbon atoms, X is identical or different and is a halogen, preferably chlorine, or OH, $OR^2$, $OCOR^2$, $O(CH_2)_xOR^2$, $R^2$ is identical or different and is monovalent hydrocarbon radical having 1 to 8 carbon atoms, n is 1 or 2, preferably 2, and x is 1,2 or 3 preferably 1, and/or organosiloxanes of the formula $(R^1_aX_bSiO_{1/2})_z(R^1_2SiO_{2/2})_x(R^3R^1SiO_{2/2})_y(SiX_bR^1_a)_z$ in which $R^1$ is as defined above $R^2$ is as defined above, $R^3$ is identical or different, is a hydrogen or a monovalent, optionally halogenated, hydrocarbon radical having 1 to 18 carbon atoms which is different from $R^1$, X is as defined above, preferably OH, a is 0, 1, 2, or 3, preferably 2, b is 0, 1, 2, or 3, preferably 1, the sum of A+B being equal to 3, x is 0 or an integer from 1 to 200, preferably from 10 to 50, y is 0 or an integer from 1 to 200, with x to y preferably being at least equal to 5 to 1, and the sum x+y being equal to 0 or an integer between 1 and 200, preferably from 10 to 50, z is 0 or 1 with the proviso that z is greater than 0 if the sum of x+y is 0, and z is preferably 1.

The positively charged particles used in the present invention can be prepared by any known method in art. In a preferred embodiment, the positively charged particles comprise chemically treated fumed silica or colloidal silica. Preferable material which can be used for the chemical treatment includes a silicon compound having a nitrogen atom combined in the structure. Examples include, but are not limited to, amninopropyltrimethoxysilane, aminopropyltriethoxysilane, dipropylaminopropyltrimethoxysilane, dibutylaminopropyltrimethoxysilane, monobutylaminopropyldimethylmethoxysilane, dibutylamninopropyldiethylmonomethoxysilane, dimethylaminophenylethoxysilane, gamma-propylphenylamine, substituted trimethoxysilane, and gamma-propylmorpholine-substituted trimethoxysilane.

A process of manufacturing modified silica is described in Barthel et al, "The Surface Modification of Silicas on the Free Flow and Charging Properties of Monocomponent Magnetic Toners," included the 1996 edition of the International Conference on Digital Printing Technologies, NIP 12, sponsored by the Imaging Sciences and Technology Society, pp. 511–516.

The negatively charged particles and positively charged particles which are composed of organic or inorganic oxide particles subjected to any of the aforementioned treatments may be used in any amount, and preferably in a ghost-reducing effective amount. This amount is more preferably within a range of about 0.01 to 5 parts, and even more preferably 0.5 to 3 parts, by weight based on 100 parts by weight of the image-forming particles.

Lubricant

The toner used in the present invention contains a lubricant, preferably selected from the group of metallic fatty acid salts with the following chemical structure:

$$M\{OOC—(CH_2)n—CH_3\}_m$$

where n=5–100, m=1–5 and M denotes mono or multivalent cation(s) including; Li, Na, Mg, Al, Zn, K, Ca, Cu, Co, Cr, Fe, Ni, Be, Rb, Ag, Sr, and Ba, and more preferably said metal fatty acid salt particle with a Ds50/Dt50≦0.9, and even more preferably with a Ds50/Dt50≦0.6, where_Ds50 is the median volume diameter of the metal fatty acid particle grain size and Dt50 is the median volume diameter of the toner particle grain size and/or Ds84/Ds16≦8.0, where Ds84 represents the diameter at 84% of the accumulated undersize distribution curve of the metal salt of the metallic fatty acid particle grain size and Ds16 represents the diameter at 16% of the accumulated undersize distribution curve of the metal salt of the metallic fatty acid particle grain size, respectively. The metallic salt of a fatty acid is preferably comprised within a range where n=6–18, and where the preferred metal is often Zinc.

Counter ions of the metallic fatty acid salt that can be used include Li, Na, K, Cu, Rb, Ag, Zn, Mg, Ca, Sr, Al, Fe, Co, and Ni. Best results were obtained using Zn, Mg, Ca, and Al stearates.

Lubricants have been successfully used that are based on a combination of Zn stearate, palmitate, and myristate, or Zn stearate with minor amounts, such as up to 3% of the unreacted stearic acid and other insignificant impurites. The most preferred lubricant is a mixture of 56% zinc stearate, 40% zinc palmitate and 2% zinc myristate with a median particle size of 2–5 microns.

The lubricant is present in accumulated toner contamination-reducing effective amounts, i.e., amounts sufficient to avoid or at least reduce contamination of the CCR and photoconductor, and image defects, by undesirable accumulated toner after multiple printings, and thus in amounts sufficient to extend the useful life of the CCR and photoconductor before cleaning or replacement. The amount of lubricant is generally within a range of about 0.01–5.0 parts, and even more preferably 0.01–2.0 parts, by weight based on 100 parts by weight of the image-forming particles.

The present invention also includes a method of reducing or eliminating contamination of a photoconductive drum assembly or a direct pliotoconductor charging apparatus or both, which comprises carrying out electrostatic development in the presence of same with the electrostatic developer composition of the present invention, and wherein the photoconductive drum assembly can be an organic photoconductor and the photoconductor charging apparatus can be a contact charge roller.

Having generally described this invention, a further understanding can be obtained by reference to certain specific examples which are provided herein for purposes of illustration only and are not intended to be limiting unless otherwise specified. These examples describe, but are not limited to, the preparation of toner by conventional process means as described below.

EXAMPLES

All Examples and Comparative Examples are of electrostatic developers and were subjected to an image formation test by using a commercially available LED printer using a negative chargeable organic photoconductor (OPC) and negative charge contact roller (CCR). In the following Examples and Comparative Examples, "parts by weight" is merely written as "parts".

Evaluation was carried out under normal temperature and humidity conditions; 55–75 F, 40–70% RH.

The most conventional process for toner manufacturing includes the steps of (1) premixing, (2) kneading, (3) pulverizing or classifying, (4) postadding and (5) sifting. This invention relates specifically to step (4), i.e. postadding, with special additives to ensure proper toner and print quality. The following examples are specific to this step of the manufacturing process. In each of the Examples and Comparative Examples, image fomiing particles were the same; only the additive was different. After sifting step (5), each of the Examples and Comparative Examples were tested for ghosting, image density, background, etc. under normal temperature and humidity conditions.

Table 1 identifies the presence/absence of the negatively charged particles, the positively charged particles, and the lubricant, and amounts of each, for each Example and Comparative Example.

Table 2 identifies the chemical nature of the negatively and positively charged particles used in the Examples and Comparative Examples, as well as BET and Q/M, described below. See Barthel et al, supra, for a technique for measuring Q/M.

Table 3-1 presents ghosting test results.

Table 3-2 presents long life testing results with visual observation of contamination of CCR (charge contact roller) and OPC drum after running 20,000 prints with 15% character coverage on the print page.

Table 3-3 presents analogous long life testing results to the test results in Table 3-2, except that the test was performed with 90,000 prints with 5% character coverage on the print page.

Example 1

Styrene-butyl acrylate copolymer, Mw=$15.5\times10^4$, 100 parts; magnetite (Os=80–100 emu/g, Hc=80–130 Oe, all measured in a 9.8 k field, and a BET value of 3–10 $m^2$,/g), 110 parts; propylene wax (Mw: 7000) 6 parts; and a chromium based organic metal complex, 0.8 parts; were all well blended in a Henschel Mixerblender and kneaded by means of a twin screw extruder. The kneaded product was cooled, coarsely crushed by hammer milling, finally pulverized and classified to obtain black particulate having a volume median particle size of 9.0 microns. Then 100 parts ofthe above black particulate were mixedwith 0.80 parts of negatively charged silica A, 0.15 parts of positively charged silica B and 0.05 part of lubricant X together with 0.03 part of magnetite (average diameter of 0.5 microns). Silica A was a fumed silica post treated with polydimethylsiloxane (PDMS), silica B was a famed silica post treated with polydimethylsiloxane having quaternary ammonium and amino functional groups, and lubricant X was a mixture of 56% zinc stearate, 40% zinc palmitate, and 2% zinc myristate, with $2 \leqq D_{50} \leqq 5$ (wherein $D_{50}$ has the same meaning as given above and is normally measured in microns), and $1 \leqq Ds_{84}/Ds_{16} \leqq 5$. The resultant mixture was passed through a 100-mesh screen to obtain Example 1. Particle size and particle size distribution measurements were typically made using the dry technique that includes the use of a Heros and Redos laser diffraction instrument manufactured by Sympatec.

Example 1 was subjected to a 20,000 page continuous character print test using a midrange speed (20–50 prints/minute) laser printer machine. After a prescribed patterned-printing test using an alphanumeric printing pattern was performed, long life testing was performed with 15% character print coverage, i.e., 15% coverage on the printed page (20,000 prints) and with 5% character print coverage on the printed page (90,000 prints). In the charge measurement test the development sleeve was removed from the machine carefully to maintain the toner layer on the surface of the development sleeve for measurement purposes. The photoconductor and CCR were visually inspected for contamination, and the prints were visually inspected for defects.

In the charge measurement test the toner charge on the development sleeve surface was measured using a Keithly 617 Programmable Electrometer probe. The probe is attached to a specially prepared contact, i.e., a copper wire attached to a section of the development sleeve container to allow contact with a metal surface, connected with the development sleeve, to allow for charge measurement. The toner layer on the development sleeve was removed using a vacuuming device connected to a suitable covered container that includes 2.7 um pore size glass microfiber filter or the equivalent, such that the toner is trapped during vacuuming. The toner weight (M) is measured by first measuring the tare weight of the container (empty) and then weighing the container after vacuuming is completed. As vacuuming occurs, the "mirror" or opposite of the measured charge on the surface of the development unit is determined and is assumed to be the sum of the toner charge that is removed from the development sleeve and denoted as "Q". "Q/M–B" is defined as Q/M after making 10 black prints and "Q/M–W" is defined as Q/M after making 10 white prints with the same machine. "R" is defined as the absolute value of (Q/M–B/Q/M–W) and used as an index for measurement of the toner charge stability after black and white page printing is completed. A toner composition with $0.7 \leqq R \leqq 2.5$ is considered to have good charge stability performance. When R is outside this range, the image quality will not be consistent during the consumption of toner from a given cartridge.

Measurements of the image density (ID) were made by an RD918 densitometer available from MacBeth Corporation. A density greater than 1.30 is considered acceptable.

Ghosting was evaluated with a black page print after 10 pages of continuous white page prints were processed through the electrophotographic machine. The density of the top portion of the black print which is corresponding to the first cycle of the development sleeve was compared with the density of the remaining portion of the black print and ranked visually as follows:

3=no obvious difference

2=slight difference,

1=very obvious difference.

Background (BG) was evaluated using a visual check.

Photoconductor and CCR contamination was also evaluated by visual inspection on each component (OPC and CCR) and on white chart "print" and ranked as follows:

3=no obvious contamination seen on the photoconductor and CCR as well as no print defect seen on the white print, 2=slight contamination observed on either or both the photoconductor and CCR with no print defect seen on the white print, 1=obvious contamination observed on either or both the photoconductor and CCR with print defects seen on the white print.

The obtained toner showed good image quality including image density, background and other print characters during the 20,000 continuous character print test. Also the toner did not contaminate the photoconductor and CCR after 20,000 prints. Furthermore the toner showed excellent ghosting performance and good charging stability with a charge stability ratio value of R=0.91.

TABLE 1

| Example | Negatively Charged Particles | Positively Charged Particles | Lubricant |
|---|---|---|---|
| 1 | silica A/0.80 part | silica B/0.15 part | Lubricant X/0.05 part |
| 2 | silica A/0.90 part | silica B/0.15 part | Lubricant X/0.05 part |
| 3 | silica C/0.90 part | silica B/0.15 part | Lubricant X/0.05 part |
| 4 | silica D/0.90 part | silica B/0.15 part | Lubricant X/0.05 part |
| 5 | silica D/0.60 part<br>silica E/0.30 part | silica B/0.15 part | Lubricant X/0.05 part |
| 6 | silica F/0.80 part | silica B/0.15 part | Lubricant X/0.05 part |
| 7 | silica G/0.80 part | silica B/0.15 part | Lubricant X/0.05 part |
| C1 | silica A/1.00 part | None | none |
| C2 | silica A/0.80 part | silica B/0.15 part | none |
| C3 | none | silica B/0.80 part | none |
| C4 | silica A/0.50 part | silica B/0.15 part | none |
| C5 | silica D/0.60 part<br>silica E/0.15 part | silica B/0.15 part | none |
| C6 | silica D/0.80 part | silica B/0.15 part | none |

TABLE 2

| Negatively Charged Particles | Post Treatment | BET | Q/M |
|---|---|---|---|
| Silica A | PDMS | 100 ± 20 | −624 |
| Silica C | DCDMS | 110 ± 20 | −823 |
| Silica D | HMDS | 260 ± 30 | −929 |
| Silica E | OCTS | 150 ± 25 | −884 |
| Silica F | HMDS | 110 ± 20 | −737 |

TABLE 2-continued

| | Post Treatment | BET | Q/M |
|---|---|---|---|
| Positively Charged Particles | | | |
| Silica B | #1 | 110 ± 20 | +253 |

#1 modified Polydimethylsiloxane having quaternary ammonium and amino functional groups

TABLE 3-1

GHOSTING TEST RESULTS

| Example | ID | BG | Ghosting | Q/M-W | Q/M-B | R |
|---|---|---|---|---|---|---|
| 1 | 1.41 | good | 3 | −5.5 | −5 | 0.91 |
| 2 | 1.51 | good | 3 | −6.9 | −4.8 | 0.74 |
| 3 | 1.52 | good | 3 | −3.2 | −7.6 | 2.4 |
| 4 | 1.55 | good | 3 | −5.1 | −9.6 | 1.9 |
| 5 | 1.51 | good | 3 | −3.5 | −7.5 | 2.1 |
| 6 | 1.46 | good | 3 | −4.4 | −6.7 | 1.5 |
| 7 | 1.34 | good | 3 | −5 | −5.6 | 1.1 |
| C1 | 1.52 | good | 1 | −1.8 | −4.6 | 0.38 |
| C2 | 1.46 | good | 3 | −3.9 | −5.7 | 1.5 |
| C3 | 0.52 | good | 1 | −2.1 | −1.4 | 0.6 |

TABLE 3-2

LONG LIFE TEST RESULTS (WITH 15% PRINT)

| Example | Initial ID | Initial BG | ID (20,000 prints) | BG (20,000 prints) | CCR Contamination Photoconductor Contamination, Print Defect |
|---|---|---|---|---|---|
| 1 | 1.35 | Good | 1.47 | Good | 3 |
| 2 | 1.35 | Good | 1.43 | Good | 3 |
| 3 | 1.44 | Good | 1.45 | Good | 3 |
| 4 | 1.38 | Good | 1.4 | Good | 3 |
| 5 | 1.39 | Good | 1.38 | Good | 3 |
| 6 | 1.39 | Good | 1.44 | Good | 3 |
| 7 | 1.34 | Good | 1.32 | Good | 3 |
| C3 | 1.37 | Good | 1.4 | Good | 1 |
| C4 | 1.36 | Good | 1.4 | Good | 1 |
| C5 | 1.37 | Good | 1.45 | Good | 1 |
| C6 | 1.42 | Good | 1.45 | Good | 1 |

TABLE 3-3

LONG LIFE TEST RESULTS (WITH 5% PRINT)

| Example | Initial ID | Initial BG | ID (90,000 prints) | BG (90,000 prints) | CCR Contamination Photoconductor Contamination, Print Defect |
|---|---|---|---|---|---|
| 2 | 1.47 | Good | 1.47 | Good | 3 |
| C4 | 1.36 | Good | 1.4 | Good | 1 |

Example 2

Example 2 was prepared in the same manner as Example 1 with the exception that 0.9 parts of silica A was used instead of 0.8 parts. This change in composition also allowed for good overall results as shown in Table 3.

Example 3

Example 3 was prepared in the same manner as Example 1 except that 0.9 parts of silica C, a fumed silica post treated with dichlorodimethylsilane (DCDMS)was employed in lieu of 0.80 parts of Silica A, again allowing for good overall results as shown in Table 3.

Example 4

Example 4 was prepared in the same manner as Example 1 except that 0.9 parts of silica D, a fumed silica post treated with hexamethyldisilizane (HMDS) was employed in lieu of 0.80 parts of Silica A, and good results were again obtained as shown in Table 3.

Example 5

Example 5 was prepared in the same manner as Example 1 except that 0.6 parts of silica D and 0.30 parts of silica E, a fumed silica post treated with a particular dimethyl cyclopolysiloxane, e.g. octamethyl cyclotetrasiloxane (OCTS), were employed in place of 0.80 parts of Silica A. Once again, good results were obtained as shown in Table 3.

Example 6

Example 6 was prepared in the same manner as Example 1 except that 0.9 parts of silica F, a fumed silica post treated with hexamethyldisilizane (HMDS) (differing from Silica D as shown in Table 2) was employed in place of 0.80 parts of Silica A. This composition also resulted in good performance characteristics as shown in Table 3.

Example 7

Example 7 was prepared in the same manner as Example 1 except that 0.9 parts of silica G, a famed silica post treated with polydimethylsiloxane (PDMS) (differing from Silica A as shown in Table 2) was employed in place of 0.80 parts of Silica A. This composition also resulted in good performance characteristics as shown in Table 3.

Comparative Example 1

The same image forming particle composition as described in Example 1 wherein 100 wt. parts of the black particulate as described above were mixed with 1.00 part of silica A. This composition exhibited severe ghosting and a small R value of 0.38 was obtained.

Comparative Example 2

The same image forming particle composition as described in Example 1 wherein 100 wt. parts of the black particulate as described above were mixed with 0.80 part of silica A and 0.15 part of silica B, whereby severe contamination was observed on photoconductor and CCR surfaces.

Comparative Example 3

The same image forming particle composition as described in Example 1 wherein 100 wt. parts of the black particulate as described above were mixed with 0.80 parts of silica B, resulting in severe ghosting and very (unacceptable) low image density.

Comparative Example 4

The same image forming particle composition as described in Example 1 wherein 100 wt. parts of the black particulate as described above were mixed with 0.50 parts of silica A and 0.15 part of silica B, resulting in poor print defects with high levels of toner contamination on the surface of the photoconductor and contact roller.

Comparative Example 5

The same image forming particle composition as described in Example 1 wherein 100 wt. parts of the black particulate as described above were mixed with 0.60 parts of silica D and 0.15 parts of silica E and 0.15 part of silica B resulting in poor print defects with high levels of toner contamination on the surface of the photoconductor and contact roller.

Comparative Example 6

The same image forming particle composition as described in Example 1 wherein 100 wt. parts of the black particulate as described above were mixed with 0.80 parts of silica D and 0.15 part of silica B resulting in poor print defects with high levels of toner contamination on the surface of the photoconductor and contact roller.

Every description in the above specification of a numerical range and of a genus is intended to inherently include a description of all possible values and subranges within the range, and all possible species and subgenuses within the genus, respectively.

Obviously, numerous modifications and variations of the present invention are possible in light of the above teachings. It is therefore to be understood that within the scope of the appended claims, the invention may be practiced otherwise than as specifically described herein.

We claim:

1. A mono-component electrostatic developer comprising a mixture of (1) toner components containing magnetic image-forming particles, (2) positively charged particles, (3) negatively charged particles, and (4) a lubricant, wherein the lubricant comprises metal fatty acid salt particles selected from the group consisting of metallic salts of fatty acids with the chemical structure:

$$M\{OOC—(CH_2)_n—CH_3\}_m$$

where n=5–100, m=1–5 and M denotes mono or multivalent cation(s), wherein the lubricant is present in accumulated toner contamination-reducing effective amounts, and which electrostatic developer produces an R value of $$0.7 \leqq R \leqq 2.5$$

wherein R is the absolute value of (Q/M after making 10 black prints/Q/M after making 10 white prints) and wherein Q is the triboelectric charge of said toner components and M is a mass of said toner components as measured on a development sleeve.

2. The electrostatic developer of claim 1, wherein said metallic fatty acid salt particles and toner component imaging particles are present in a ratio of $Ds50/Dt50 \leqq 0.9$, wherein Ds50 represents the volume median particle size of said metallic fatty acid salt particles and Dt50 represents the volume median particle size of said toner component particles.

3. The electrostatic developer of claim 2, wherein said particles of a metallic salt of a fatty acid and toner component imaging particles are present in a ratio of $Ds50/Dt50 \leqq 0.6$.

4. The electrostatic developer of claim 2, wherein said metallic fatty acid salt particles are present in a ratio of $Ds84/Ds16 \leqq 8$, wherein Ds84 represents the diameter at 84% of the accumulated undersize distribution curve of said metallic fatty acid salt particles and Ds16 represents the diameter at 16% of the accumulated undersize distribution curve of said metallic fatty acid particles.

5. The electrostatic developer of claim 1, wherein said particles of components (2) and (3) comprise an inorganic oxide selected from the group consisting of $SiO_2$, $Al_2O_3$, $W_2O_3$, $ZrO_2$, SeO, $TiO_2$, ZnO and MgO.

6. The electrostatic developer of claim 5, wherein said particles of component (2) comprise positively charged particles of silicon dioxide and said particles of component (3) comprise negatively charged particles of silicon dioxide.

7. The electrostatic developer of claim 6, wherein positively charged particles comprise silica surface treated with polydimediylsiloxane containing amino-functional groups and quaternary ammonium functional groups.

8. Tle electrostatic developer of claim 6, wherein negatively charged particles comprise silica surface treated with at least one of hexamethyl disilazane, dimethyl cyclopolysiloxane, dimethyl dichlorosilane and polydimethylsiloxane groups.

9. The electrostatic developer of claim 1, wherein component (4) is present in an amount of 0.01–5.0 parts by weight per 100 parts of component (1).

10. The electrostatic developer of claim 1, wherein components (2) and (3) are present in ghost-reducing effective amounts.

11. The electrostatic developer of claim 1, wherein components (2) and (3) are each present in an amount of about 0.01 to 5 parts by weight per 100 parts of component (1).

12. The electrostatic developer of claim 11, wherein components (2) and (3) are each present in an amount of about 0.05 to 3 parts by weight per 100 parts of component (1).

13. The electrostatic developer of claim 1, wherein components (2) and (3) are each present in an amount of about 0.01 to 3 parts by weight per 100 parts of component (1).

14. A method of reducing or eliminating contamination of a photoconductive drum assembly or a direct photoconductor charging apparatus or both, which comprises carrying out electrostatic development in the presence of same with the electrostatic developer composition according to claim 1.

15. The method of claim 14, wherein said photoconductive drum assembly is an organic photoconductor.

16. The method of claim 15, wherein the organic photoconductor is a negative photoconductor.

17. The method of claim 14 wherein said photoconductor charging apparatus is a contact charge roller.

18. The method of claim 17, wherein the contact charge roller is a negative contact charge roller.

19. A mono-component electrostatic developer comprising a mixture of (1) toner components containing magnetic image-forming particles, (2) positively charged particles, (3) negatively charged particles, and (4) a lubricant comprising a combination of zinc stearate, zinc palmitate and zinc myristate.

20. The electrostatic developer of claimed 19, wherein the lubricant comprises a mixture of, by weight, 56% zinc stearate, 40% zinc palmitate and 2% zinc myristate.

21. The electrostatic developer of claim 20, wherein the lubricant has a median particle size of 2–5 $\mu$m.

* * * * *